United States Patent [19]

Fagot

[11] Patent Number: 4,971,350

[45] Date of Patent: Nov. 20, 1990

[54] ALPINE SKIS

[75] Inventor: Jacques Fagot, Saint Jean De Moirans, France

[73] Assignee: Skis Rossignol S.A., France

[21] Appl. No.: 446,672

[22] Filed: Dec. 6, 1989

[30] Foreign Application Priority Data

Dec. 7, 1988 [FR] France ..... 88 17569

[51] Int. Cl.[5] ..... A63C 5/04

[52] U.S. Cl. ..... 280/609

[58] Field of Search ..... 280/601, 608, 609, 610

[56] References Cited

U.S. PATENT DOCUMENTS

| | | | |
|---|---|---|---|
| 3,272,522 | 9/1966 | Kennedy III | 280/610 |
| 4,700,967 | 10/1987 | Meatto et al. | 280/609 |
| 4,838,572 | 6/1989 | Diard et al. | 280/609 |
| 4,869,523 | 9/1989 | Diard et jal. | 280/609 |
| 4,895,388 | 1/1990 | Richmond | 280/609 |

FOREIGN PATENT DOCUMENTS

| | | |
|---|---|---|
| 1939540 | 5/1986 | Fed. Rep. of Germany . |
| 1343014 | 2/1964 | France . |

*Primary Examiner*—Charles A. Marmor
*Assistant Examiner*—Michael Mar
*Attorney, Agent, or Firm*—Oliff & Berridge

[57] ABSTRACT

A downhill ski has side walls which form, over at least a part of their length, an acute angle with the base and have a continuously varying slope and are asymmetrical. The slope angle of one of the side walls increases from tip to waist and decreases from waist to tail, while the slope angle of the other side wall decreases from tip to waist and increases from waist to tail. The two skis of a given pair are symmetrical to one another relative to a longitudinal plane located midway between the two skis, so that like side walls can be alternately positioned adjacent each other to suit different snow conditions. The construction provides enhanced versatility for varying snow conditions.

17 Claims, 3 Drawing Sheets

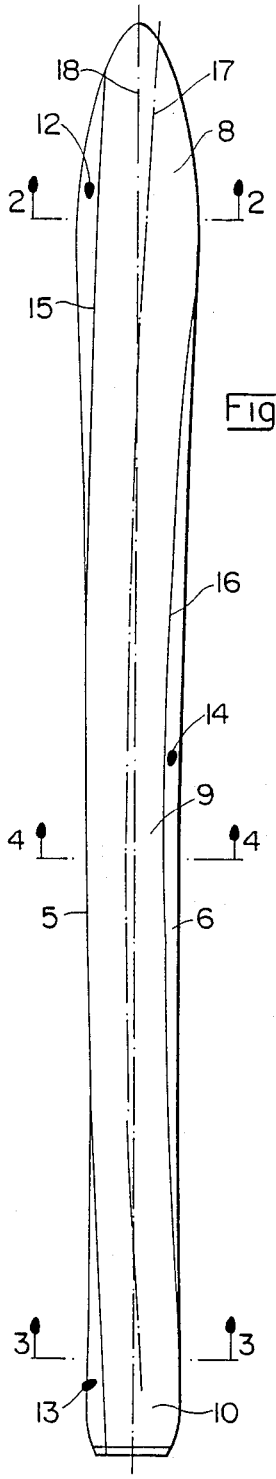
Fig- 1
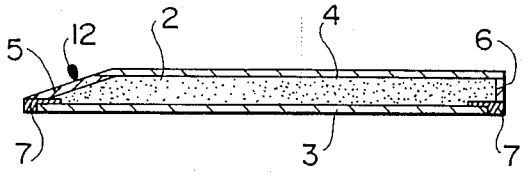
Fig- 2
Fig- 4
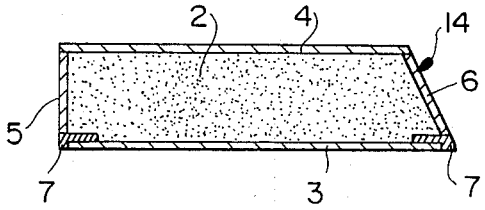
Fig- 3
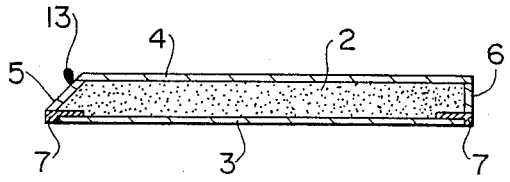

ALPINE SKIS

FIELD OF THE INVENTION

This invention relates to alpine or downhill skis.

BACKGROUND OF THE INVENTION

Downhill skis are used under various conditions on prepared trails, or off trails and on snow of different types, such powder snow, packed snow, or hard or even frozen snow. It is well known that, depending on its structure and hence on the nature and arrangement of the materials of which it is composed, a ski can adapt better to changes on certain types of terrain and to certain types of snow than others. Thus, in order to ski on a hard or frozen trail where good traction is required, it is important to have a responsive ski in which vibrations are eliminated. When skiing in powder snow, the responsiveness of the ski is less important. In fact, on hard snow, the mechanism for starting and making a turn, at the moment the edge "bites," brings into play the inside edge of the outside ski on the turn. The skier, by controlling the magnitude and direction of the force on that edge, makes a turn with a larger or smaller radius. On the other hand, in powder snow, the mechanism for starting a turn is completely different, since the skier makes the turn by pivoting the ends of the skis laterally around the axis of the skier.

It is therefore understandable that it is sometimes difficult to use the same skis, with optimum results, on different kinds of snow.

It has been suggested that a ski be designed with an essentially rectangular cross section and having side walls made of materials with differing mechanical characteristics. The two skis of a given pair have corresponding side walls made of different materials so that it is possible for the user, by switching his two skis, to arrange the side walls with the same characteristics either side by side or opposite one another. On powder snow, the side walls made of the more rigid material are positioned on the outside while in hard snow, by switching the two skis, they are placed side by side.

Nevertheless, while this technique does produce a certain improvement in behavior relative to traditional skis, it does not provide a ski which is perfectly adapted to maneuvers under the best conditions, on snow with very different characteristics.

It may be said that the changes in structure are not sufficient to solve this problem of versatility in skis. There is another parameter which can influence the ease with which a turn is executed in powder snow; that is the shape of the ski. It has been explained that in powder snow the ends of the skis must pivot laterally. In order to facilitate the penetration of the skis into the snow layer, it is important to limit the "cutting force" by using a sloping surface.

For this purpose, skis have been designed whose upper surface is connected to the lower surface by sloping side walls (French Patent 1,343,014. The slope angle of the side walls relative to the lower face can vary along the ski, so as to be more acute at the tip and tail than at the waist (U.S. Pat. 3,272,522). The slope of the side walls can also be asymmetrical, with one side more acute than the other (German utility model registration No. 1,939,540).

Although it is undeniable that these skis with sloping side walls improve the ease of execution of turns in powder snow, it must be noted that this slope, at the point where the foot presses down the inner edge, does not aid in the performance of the ski on hard snow because this pressure, or "bite," lacking firmness, loses its effectiveness when the turn is made.

It would therefore be appropriate for a skier who always wants to ski under optimum conditions to have several pairs of skis available, each designed for one specific kind of snow. This is difficult for financial reasons and practical reasons, which do not always allow simultaneous transportation of several pairs of skis by a single individual. As well, rapid changes in the nature of the terrain and/or the quality of the snow do not allow an immediate change of skis.

A skier is therefore generally obliged to select a ski which represents a compromise, with predominant characteristics corresponding to the type of terrain and snow that the skier prefers.

SUMMARY OF THE INVENTION

An object of the present invention is to improve the versatility of existing skis by providing a ski with a suitable form which gives it excellent behavior both on hard snow and powder snow.

The ski has asymmetrical side walls, each forming an acute angle with the base over at least a part of their length. The inclination of each side wall varies continuously. One of the side walls has an inclination increasing from the tip to the waist and decreasing from the waist to the tail. The inclination of the other side wall decreases from the tip to the waist and increases from the waist to the tail. The two skis of a given pair are symmetrical with respect to a plane located longitudinally midway between the two skis. Like side walls can be alternately positioned adjacent each other to suit differing snow conditions.

BRIEF DESCRIPTION OF THE DRAWINGS

The invention will be better understood from the description which follows with reference to the attached schematic diagrams showing, as a nonlimiting example, one embodiment of this ski, in which:

FIG. 1 is a top view of a ski, with the other ski of this same pair being symmetrical relative to a plane located longitudinally halfway between the two skis;

FIGS. 2 to 4 show three schematic views in cross section on an enlarged scale, respectively along lines II—II, IIIIII, and IV—IV in FIG. 1;

DESCRIPTION OF THE PREFERRED EMBODIMENT

Figure 5:
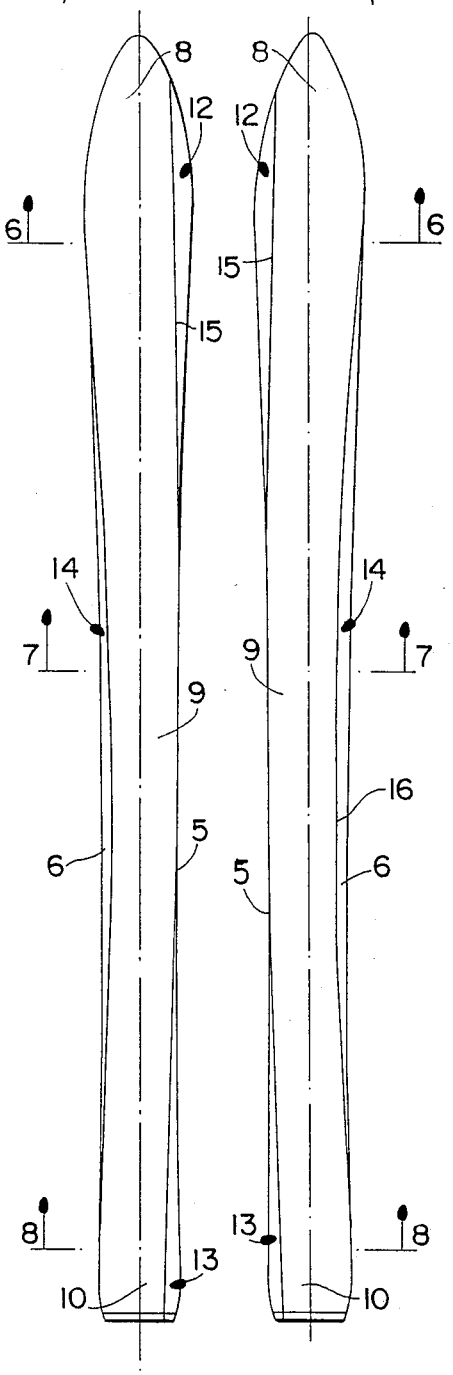
FIG. 5 is a top view of a pair of skis in a configuration designed for skiing on hard snow.
Figure 6:
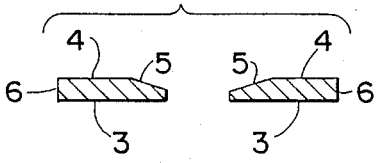
FIGS. 6 to 8 are three schematic views in cross section through this pair of skis, respectively along lines VI—VI, VII—VII, and VIII—VIII in FIG. 5.
Figure 7:
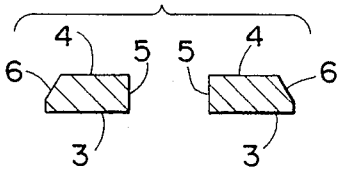
Figure 8:
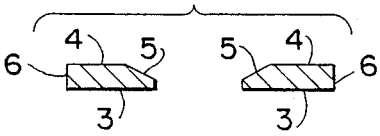

The ski shown in the drawings has central part 2, delimited by a lower face 3, an upper face 4, and two side walls 5 and 6. Edges 7 are provided at the junctures between lower face 3, and each of side walls 5 and 6.

The ski according to the invention likewise includes, in known fashion, a certain number of zones that are displaced axially relative to one another, to wit, from front to back, a front zone or tip 8, a middle zone or waist 9, and a rear zone or tail 10.

Side wall 5, in the vicinity of the tip and tail, is inclined from the outside of the ski toward the inside, and from lower face 3 toward upper face 4. These sloping surfaces, designated respectively by references 12 and 13, form an angle with the lower face of the ski which increases continuously from each end of the ski toward the central part or waist thereof. Conversely, the width of each sloping part 12, 13 decreases when approaching the middle of the ski.

Side wall 6 is essentially perpendicular to lower surface 3 and upper surface 4 in the zones of tip 8 and tail 10, and is in the form of a surface 14 sloping from the outside toward the inside and from lower face 3 toward upper face 4, in the central zone or waist of the ski.

It should be noted that the width of sloping face 14 decreases from the waist zone toward the ends of the ski, while the angle formed between surface 14 and lower face 3 increases continuously from waist 9 toward the zones of tip 8 and tail 10.

Advantageously, at a cross section taken at any point along its length, the sum of the slope angles of the two side walls relative to the base is between 120° and 150°.

One of the particular features of this ski is that the variations in the inclination of the side walls (decreasing from the tip to the waist and increasing from the waist to the tail, on the first side, then increasing from the tip to the waist and decreasing from the waist to the tail on the second side of the same ski) are progressive in order to prevent any discontinuities in the characteristics of mechanical resistance, flexibility, and veneering of the skis.

According to one embodiment of this ski, the sloping part of each side wall is located above a part which is perpendicular to the plane of the base and extends from the edge of the bases to the sloping part.

According to one embodiment, the variable inclination of the side walls results from the combination of an upper ski surface having a curved longitudinal axis and a base of the ski which is symmetrical about a longitudinal rectilinear axis. As shown particularly in FIG. 1, chamfers 15 and 16 delimited by upper face 4 and inclined parts 12, 13 on the one hand, and 14 on the other hand, are located on curved lines. Consequently, the upper face of the ski, whose surface area is less than that of lower face 3, forms a curved surface, the axis 17 of which intersects the longitudinal median plane 18 of the lower face in front of and behind the area of waist 9.

The two chamfers delimiting the top face can be situated on arcs of concentric circles, on arcs of circles with the same radius and different centers, on arcs of circles with different radii and different centers, on arcs of circles produced by smoothing several arcs of circles, on sections of known geometric curves, such as a parabola, hyperbola, or ellipse, or on curves obtained by smoothing several of these known geometric curves.

The two skis of a given pair have a symmetrical structure so that the skier can put on the two skis in the manner shown in FIG. 5 if he wants to ski on hard snow. In such cases, the two skis comprise, in the area of their facing side walls, parts that essentially form right angles with the upper and lower faces at waist 9. In this case, the side wall of each ski facing inward is essentially vertical at the waist which ensures a "firm bite" and promotes traction of the ski on the snow. In this position, at the waist, the external side walls of both skis are sloped, which reduces the friction on the snow.

Figure 9:
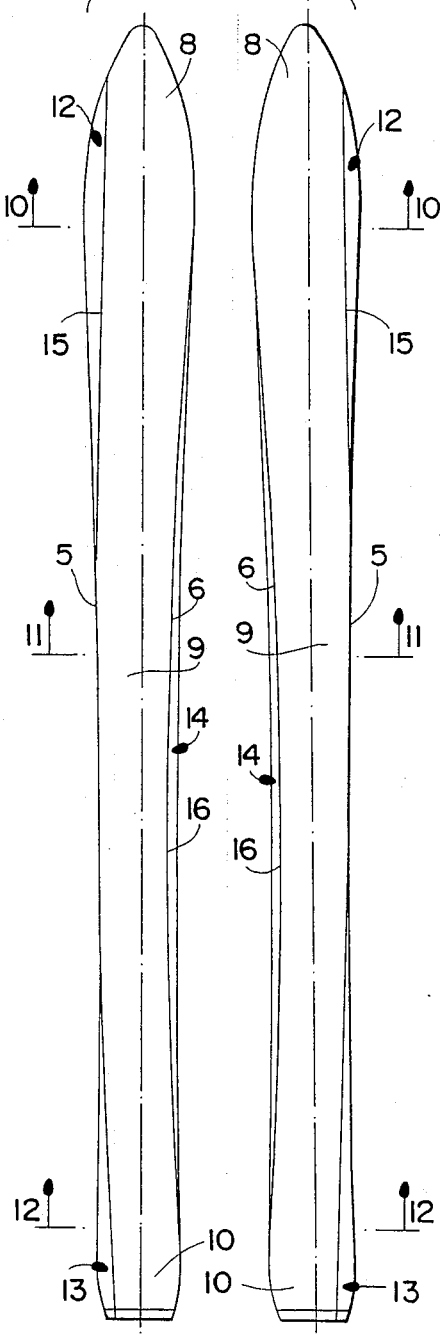
FIG. 9 is a top view of the same pair of skis in a configuration designed for skiing on powder snow.
Figure 10:
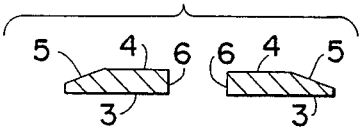
FIGS. 10 to 12 are three schematic cross-sectional views of this pair of skis along lines X—X, XI—XI, and XII—XII in FIG. 9.
Figure 11:
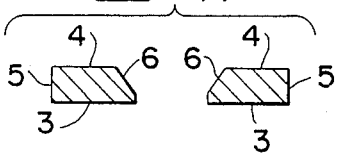
Figure 12:
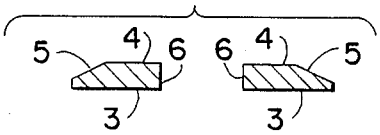

When the skier wants to ski on powder snow or off the trail, he puts on his skis in the manner shown in FIG. 9. In this case, side walls 5 are located on the outside, facing outward. The inclined surfaces located near the tip and tail favor the making of turns by splitting or cutting through the layer of powder snow. Side walls 6 are located opposite one another, with the inclined surfaces 14 thereof favoring removal of the snow cushion that accumulates in front of the skier's feet. On the other side of this same ski, in each of its end zones, i.e., in the zones located near the tip and the tail, the side wall is vertical. This low wall helps to reduce the risk of the skis crossing when they are "sunk" into powder snow. On this side, the side wall slopes gradually and progressively from the tip and tail toward the center of the ski until, at the waist, there is a side wall which slopes from the outside to the inside and from the base to the upper surface of the ski. In powder snow, this sloping zone makes it possible to cut through the snow cushion which tends to build up in front of the skier's feet.

As indicated by the above, the invention represents a considerable improvement to existing technology by providing a ski that has excellent versatility resulting from the asymmetry of its structure.

Of course, the invention is not limited to the single embodiment of the ski described above as an example; on the contrary, it includes all embodiments. Thus, for example, chamfers 15 and 16 need not be curved but can be composed of segments of straight lines, and the side walls need not be flat but may be convex or concave, without thereby departing from the scope of the invention.

What is claimed is:

1. A ski, comprising:

an elongate body having a tip section, a waist section and a tail section, a top face, a bottom face, and first and second asymmetrical side walls along opposed sides of said ski;

the first side wall having a lateral surface sloped with respect to the bottom face at an angle of inclination which increases in relation to increasing distance from the tip section to the waist section and decreases in relation to increasing distance from the waist section to the tail section and the second side wall including a lateral surface sloped with respect to the bottom surface at an angle of inclination which decreases in relation to increasing distance from the tip section to the waist section and increases in relation to increasing distance from the waist section to the tail section.

2. A ski as in claim 1, wherein the sum of the angles of the sloped surfaces of the two side walls with respect to the bottom surface, at a cross section taken substantially at any point from the tip section to the tail section, is from about 120° to about 150°.

3. A ski as in claim 1, wherein the longitudinal axis of the top face is curved and the longitudinal axis of the bottom face is rectilinear, thereby resulting in the varying angular relationships of the sloped surfaces of the side walls with the bottom face.

4. A ski as in claim 3, wherein the bottom face is symmetrical about its longitudinal axis.

5. A ski as in claim 4, wherein chamfers formed between the top face and the sloped portions of the side walls are located on arcs of concentric circles.

6. A ski as in claim wherein the angles of the sloped portions of the first and second side surfaces with respect to the bottom face are continuously variable from the tip to the waist and from the waist to the tail.

7. A ski as in claim 5, wherein chamfers formed between the top face and the sloped portions of the side walls are located on arcs of circles of the same radius having different centers.

8. A ski as in claim 5, wherein chamfers formed between the top face and the sloped portions of the side walls are located on arcs of circles having different radii and different centers.

9. A ski as in claim 5, wherein chamfers formed between the top face and the sloped portions of the side walls are located on arcs of circles obtained by smoothing several arcs of circles.

10. A ski as in claim 5, wherein chamfers formed between the top face and the sloped portions of the side walls are located on geometric curves.

11. A ski as in claim 10, wherein the geometric curves are selected from the group consisting of parabolas, hyperbolas, ellipses and curves resulting from the smoothing of such curves.

12. A ski as in claim 5, wherein the side walls include a portion perpendicular to a plane of the bottom face and extending from an edge of the bottom face to the sloped surfaces.

13. A ski as in claim I, wherein the side walls include a portion perpendicular to a plane of the bottom face and extending from an edge of the bottom face to the sloped surfaces.

14. A pair of downhill skis, each ski comprising:

a body having a tip, section a waist section and a tail section, a top, a base and first and second opposed side walls extending between the top and the base;

a first side wall of each ski including a continuously variable sloped portion, the slope of which relative to the base increases in relation to increasing distance from the tip section to the waist section and decreases in relation to inereasing distance from the waist section to the tail section;

a second side wall of each ski having a continuously variable sloped portion, the slope of which relative to the base decreases in relation to increasing distance from the tip section to the waist section and increases in relation to increasing distance from the waist section to the tail section;

the side walls being positioned on each ski in opposite relationship with respect to the other ski, whereby in use, like side walls are positionable adjacent each other.

15. A pair of skis as in claim 14, wherein the sum of the angles of the sloped portions of the side walls with respect to the base, at a cross section taken substantially at any point from the tip section to the tail section of each ski, is from about 120° to about 150°.

16. A pair of skis as in claim 15, wherein the side walls include a portion perpendicular to the plane of the base and extending from an edge of the base to the sloped portions.

17. A pair of skis as in claim 14, wherein the skis are symmetrical with respect to a plane located longitudinally midway between the two skis.

* * * * *